US009388556B2

(12) United States Patent
Koboshi et al.

(10) Patent No.: US 9,388,556 B2
(45) Date of Patent: Jul. 12, 2016

(54) MICRO-BUBBLE GENERATOR OF CARBON DIOXIDE

(71) Applicant: Hot Album Tansansen Tablet, Inc., Tokyo (JP)

(72) Inventors: Shigeharu Koboshi, Tokyo (JP); Hiroshi Yoshimoto, Tokyo (JP); Toshio Sasaki, Sagamihara (JP)

(73) Assignee: HOT ALBUM TANSANSEN TABLET, INC., Tokyo (JP)

( * ) Notice: Subject to any disclaimer, the term of this patent is extended or adjusted under 35 U.S.C. 154(b) by 146 days.

(21) Appl. No.: 14/338,555

(22) Filed: Jul. 23, 2014

(65) Prior Publication Data

US 2015/0035178 A1 Feb. 5, 2015

(30) Foreign Application Priority Data

Jul. 30, 2013 (JP) ..... 2013-004739
Sep. 11, 2013 (JP) ..... 2013-005301
Feb. 14, 2014 (JP) ..... 2014-000715

(51) Int. Cl.
*B01F 3/04* (2006.01)
*A61H 33/02* (2006.01)
(Continued)

(52) U.S. Cl.
CPC ..... *E03C 1/025* (2013.01); *A61H 33/02* (2013.01); *A61H 33/028* (2013.01); *A61H 33/6036* (2013.01); *B01F 1/0033* (2013.01); *B01F 3/04021* (2013.01); *B01F 3/0446* (2013.01);
(Continued)

(58) Field of Classification Search
CPC ..... B01F 3/04; B01F 3/04021; A61H 33/02
USPC ..... 261/115
See application file for complete search history.

(56) References Cited

U.S. PATENT DOCUMENTS 5,758,828 A * 6/1998 Takahashi ..... A61H 9/00 239/309

FOREIGN PATENT DOCUMENTS

JP 02252423 A * 10/1990
JP 11-123228 A 5/1999
(Continued)

*Primary Examiner* — Robert A Hopkins
(74) *Attorney, Agent, or Firm* — Wenderoth, Lind & Ponack, L.L.P.

(57) ABSTRACT

A first object of the present invention is to provide a micro-bubble generator of carbon dioxide which is arranged so as to enhance health promoting effects such as improvement of blood circulation due to carbon dioxide gas generated by dissolving a tablet, thereby exhibiting effects of taking a shower of bicarbonate with appropriate concentrations for a prolonged period of time. And, a second object thereof is to provide a micro-bubble generator of carbon dioxide which is arranged so that a rate of dissolution of a carbonated bath tablet is optimized, by which the tablet is kept longer, exchanged less frequently, resulting in reduction in running costs, and also the generator can be attached to a generally available shower unit, thus making it possible to exchange and load the tablet easily and in a short period of time, and the present invention is characterized that a micro-bubble generator of carbon dioxide which is installed at a water supply channel of hot water to eject carbon dioxide gas/micro-bubbles mixed water, and a micro-bubble generator of carbon dioxide which is disposed between a shower unit and a hose, having an opening/closing mechanism, in which there is installed a carbonated bath tablet accommodating portion for accommodating a carbonated bath tablet.

9 Claims, 6 Drawing Sheets

(51) Int. Cl.

| | |
|---|---|
| ***E03C 1/02*** | (2006.01) |
| ***B01F 5/00*** | (2006.01) |
| ***B05B 1/18*** | (2006.01) |
| ***B01F 1/00*** | (2006.01) |
| ***E03C 1/046*** | (2006.01) |
| ***A61H 33/00*** | (2006.01) |

(52) U.S. Cl.
CPC . *B01F 5/008* (2013.01); *B05B 1/18* (2013.01); *E03C 1/046* (2013.01); *B01F 2001/0061* (2013.01); *B01F 2003/04858* (2013.01); *B01F 2003/04872* (2013.01); *B01F 2003/04893* (2013.01); *B01F 2215/0052* (2013.01)

(56) References Cited

FOREIGN PATENT DOCUMENTS

| | | | | |
|---|---|---|---|---|
| JP | 2002-035645 | A | | 2/2002 |
| JP | 2002272805 | A | * | 9/2002 |
| JP | 4177660 | B2 | | 11/2006 |

* cited by examiner

MICRO-BUBBLE GENERATOR OF CARBON DIOXIDE

TECHNICAL FIELD

The present device relates to a micro-bubble generator of carbon dioxide which is used by being attached to a shower unit, etc., and capable of greatly improving effects of bathing in a carbonated spring such as improvement of blood circulation and also easily providing carbon dioxide gas/micro-bubbles mixed water having micro-bubble effects as well.

BACKGROUND ART

A mixture which contains bicarbonate (sodium hydrogen carbonate or potassium hydrogen carbonate) and an organic acid is molded by making tablets or others, thereby providing a bubble-forming composition (solid substance), and this process is applied to products such as a cleaning agent, a bathing agent, a bath-water detergent and a pool-water disinfectant. These products (solid substances) are advantageous in that they will readily dissolve when put into water, while generating carbon dioxide gas in reactions with ingredients thereof, and are also effective in enhancing commercial value as they impart a comfortable feeling from use to consumers. In particular, in a bath liquid (also referred to as a bathing agent), a great emphasis is placed on effects of improvement of blood circulation due to generation of carbon dioxide gas.

On the other hand, very small bubbles, for example, those with a diameter of 0.05 mm or less, which are referred to as micro-bubbles, are widely used in purification treatment of turbid water or discharged water and disinfecting domestic water, etc. For example, where micro-bubbles are generated at a turbid water treatment tank installed in water treatment facilities or others, pollutants suspended in turbid water can be floated and separated by allowing the bubbles to adhere to the pollutants. Where micro-bubbles are generated in closed water areas such as lakes, ponds and culture ponds, they are effective in promoting dissolution of oxygen into water.

Conventionally, as a micro-bubble shower which uses the micro-bubbles, there is known a tap-water pressure based shower which uses a swirl flow (refer to Patent Document 1).

There is also known a combination which is obtained by using a technology which dissolves a carbon dioxide gas-generating ingredient in hot water together with a technology which generates micro-bubbles to disinfect microorganisms in a liquid and purify the liquid (refer to, for example, Patent Document 2).

The technology of Patent Document 1 is such that, as found in various types of bathing agents, a carbon dioxide gas generating article is disposed as a gas generating article inside a gas-liquid mixer and an ejection port side of the gas-liquid mixer is connected to a shower head, and hot water obtained by mixing a bathing ingredient with micro-bubbles is ejected from the shower head, by which cleaning effects and health promoting effects such as improvement of blood circulation can be expected to be obtained.

On the other hand, there is also known a technology in which a carbon dioxide gas bath tablet is accommodated in the vicinity of the ejection port inside the shower head (refer to Patent Documents 3 to 5).

PRIOR ART DOCUMENTS

Patent Documents

[Patent Document 1] Japan Patent Pre-Publication No. 2008-229516

[Patent Document 2] Japan Patent Pre-Publication No. 2011-194390

[Patent Document 3] Japan Patent No. 4177660

[Patent Document 4] Japan Utility Model Registration No. 3183630

[Patent Document 5] Japan Utility Model Registration No. 3066561

SUMMARY OF THE INVENTION

Problems to be Solved by the Invention

However, the shower units relating to the above described publicly-known technologies have problems of a failure in exhibiting sufficient cleaning effects and health promoting effects such as improvement of blood circulation due to carbon dioxide gas.

Further, in the publicly-known technologies described in the Background Art, there has been found such a problem that a bath tablet is exposed to a strong water flow, resulting in quick dissolution within a short period of time, bicarbonate ions are in contact with the body of a user for a short period of time, thereby causing a drawback that effects of warming the body are not sufficiently provided and also a problem that the user is exposed to a shower of bicarbonate with high concentrations earlier, the tablet dissolves and disappears later, resulting in a shower of plain water made up of only water, by which the user needs to exchange the tablet to a new tablet within one bath time taking a shower, requiring troublesome and difficult work to exchange the tablet by opening an open portion of the shower head when hands are slippery due to soap and shampoo etc.

From the above description, a first object of the present invention is to provide a micro-bubble generator of carbon dioxide which is arranged so as to enhance health promoting effects such as improvement of blood circulation due to carbon dioxide gas generated by dissolving a tablet, thereby exhibiting effects of taking a shower of bicarbonate with appropriate concentrations for a prolonged period of time. And, a second object thereof is to provide a micro-bubble generator of carbon dioxide which is arranged so that a rate of dissolution of a carbonated bath tablet is optimized, by which the tablet is kept longer, exchanged less frequently, resulting in reduction in running costs, and also the generator can be attached to a generally available shower unit, thus making it possible to exchange and load the tablet easily and in a short period of time.

Means for Solving the Problems

In order to attain the above described objects, the present invention is arranged as follows:

1. A micro-bubble generator of carbon dioxide which is installed at a water supply channel of hot water to eject carbon dioxide gas/micro-bubbles mixed water, A micro-bubble generator of carbon dioxide which is disposed between a shower unit and a hose, having an opening/closing mechanism, in which there is installed a carbonated bath tablet accommodating portion for accommodating a carbonated bath tablet.

2. The micro-bubble generator of carbon dioxide according to the above description of 1, in which the opening/closing mechanism is arranged so as to be opened and closed by rotational movement at 360 degrees or less on the basis of a fixation reference body composed of a shower unit, thereby the carbonated bath tablet can be exchanged.

3. The micro-bubble generator of carbon dioxide according to the above description of 1 or 2, in which a water-flow restricting board for adjusting a quantity of water directly in contact with the carbonated bath tablet is installed at least on one of an inlet port side of hot water and an ejection port side thereof or on both of them.
4. The micro-bubble generator of carbon dioxide according to any one of the above descriptions of 1 to 3, in which at least a part of the carbonated bath tablet accommodating portion is made with a transparent material and the thus accommodated carbonated bath tablet can be visually observed externally.
5. The micro-bubble generator of carbon dioxide according to the above description of 3 or 4, in which at least a part of the water-flow restricting board is arranged so as to be attached in a removable manner.
6. The micro-bubble generator of carbon dioxide according to any one of the above descriptions of 1 to 5, in which the thickness of the carbonated bath tablet is thinner than the diameter thereof, and the carbonated bath tablet is accommodated in the carbonated bath tablet accommodating portion in such a manner that a direction of the diameter of the carbonated bath tablet is the same as a direction at which water will flow inside the carbon dioxide gas micro-bubble generator.
7. The micro-bubble generator of carbon dioxide according to any one of the above descriptions of 3 to 6, in which the water-flow restricting board is formed with a porous board or a network body.
8. The micro-bubble generator of carbon dioxide according to any one of the above descriptions of 1 to 7, in which the carbonated bath tablet accommodating portion is arranged so as to have a tablet supporting portion composed of a pair of wall like bodies or rod like bodies.
9. The micro-bubble generator of carbon dioxide according to any one of the above descriptions of 3 to 8, in which a water-flow restricting board is installed both on the inlet port side of hot water and on the ejection port side thereof, the tablet supporting portion composed of a pair of wall like bodies formed so as to oppose each other in a water flowing direction is installed at the water-flow restricting board installed on the ejection port side, and the carbonated bath tablet is disposed inside the pair of wall like bodies, and the water-flow restricting board installed on the inlet port side is formed with a porous board which is provided with a water-flow port which allows hot water flowing inside the pair of wall like bodies to pass through and also with an external water-flow port which allows hot water flowing outside the pair of wall like bodies to pass through.

The carbonated bath tablet preferably used in the present invention includes the following but will not be limited thereto.

(1) The carbonated bath tablet to be accommodated is such that a tablet obtained by compression molding in the presence of bicarbonate, an organic acid and polyethylene glycol is 15 kgf or more or 15 HV or more in hardness, a pH value immediately after dissolving the tablet in hot water is from 5.5 to 8.5 and the tablet is 15 mm or more in diameter.

(2) The carbonated bath tablet is a tablet obtained by compression molding in the presence of an organic acid and polyethylene glycol which are respectively from 1/10 to 1/3 and from 1/100 to 1/5 with respect to bicarbonate (sodium hydrogen carbonate or potassium hydrogen carbonate), in which a pH value of aqueous solution immediately after dissolving the tablet is from 5.5 to 8.5, and the hardness of the tablet is 15 kgf or more or 15 HV or more.

(3) The carbonated bath tablet is a tablet which contains the following anhydrides in a range of 1/100 to 1/10 of bicarbonate:

Anhydrides: anhydrous sodium carbonate and anhydrous potassium carbonate (4) The carbonated bath tablet is a tablet which contains any one of those selected from sodium n-(normal) octane sulfonate, sodium tetradecene sulfonate, sodium lauroyl sarcosinate and sodium myristoyl methyl alanine.

(5) The carbonated bath tablet is arranged so as to contain a coloring ingredient and/or an aromatic ingredient.

Effects of the Device

According to this invention given in the above description of 1, the micro-bubble generator of carbon dioxide is disposed between the shower unit and the hose, by which the carbonated bath tablet accommodated in the micro-bubble generator of carbon dioxide is dissolved by hot water, thus generated carbon dioxide gas is given time when being exposed to the hot water inside the connected shower unit, thereby giving time for attaining appropriate neutralization and also time for being changed to bicarbonate ions, thus making it possible to provide health promoting effects such as improvement of blood circulation due to bicarbonate ions.

Further, time is required for passing through the shower unit, by which after calcium hypochlorite contained in hot water has been removed by bicarbonate ions, it is possible to obtain time until shower-mode ejection is made available. It is, therefore, possible to obtain health promoting effects more greatly by reducing toxicity through the skin.

From the above description, the present invention given in the above description of 1 is able to solve the problem which is the first object of the present invention, that is, "to enhance health promoting effects such as improvement of blood circulation due to carbon dioxide gas generated by dissolving the tablet, thereby exhibiting effects of having a shower of bicarbonate with appropriate concentrations for a prolonged period of time."

According to the present invention given in the above description of 2, the tablet can be exchanged in the carbonated bath tablet accommodating portion by a simple operation that the opening/closing mechanism is operated by rotation at 360 degrees or less on the basis of the fixation reference body composed of the shower unit, and the tablet can be exchanged and loaded simply and in a short period of time. Accordingly, water is low in temperature at the start of a shower, and therefore fresh water (shower-mode ejection, with the tablet removed) is to be ejected until the water is warmed up to an appropriate temperature, thereby preventing loss of the tablet. Further, for example, primary dirt is removed by the first shower using fresh water (shower-mode ejection, with the tablet removed) and, when a user intends to enjoy a shower like whole body esthetic treatment after the primary dirt has been washed away, the user has a shower with carbon dioxide gas/micro-bubbles mixed water. It is, therefore, possible to accommodate and load the tablet by a simple operation.

According to the present invention given in the above description of 3, the water-flow restricting board is installed on one of the inlet port side of the carbon dioxide gas micro-bubble generator and the ejection port side thereof or on both of them. Thus, a quantity of water which is directly in contact with the carbonated bath tablet can be adjusted to eject mixed water with the table at an optimal concentration. Thereby, carbon dioxide gas generated by micro-bubble effects is neutralized inside the connected shower unit, and the gas is changed into bicarbonate ions at a more optimized speed and in contact with the whole body of a user, thus making it possible to enhance the efficiency of the bicarbonate ions absorbed from the skin into the blood vessels. If an excessive quantity of water is in contact directly with the tablet, the thus generated carbon dioxide gas is not neutralized or changed into bicarbonate ions, and the water is ejected in a shower mode, with the carbon dioxide gas kept, resulting in an increase in concentration of the carbon dioxide gas. And, not only are sufficient warm bath effects obtained but the tablet is used meaninglessly. The present invention is able to solve the above problem. That is, according to the present invention, only a quantity of hot water in contact with the tablet is adjusted, with a quantity of water ejected being kept, thereby slowing a rate of dissolution of the tablet. Thus, it is possible to exhibit remarkable effects that the tablet dissolves over a prolonged period of time and is exchanged less frequently, with running costs also kept low.

Further, the carbon dioxide gas micro-bubble generator is arranged so as to have the opening/closing mechanism, by which the carbonated bath tablet to be accommodated can be exchanged and loaded simply and in a short period of time.

Still further, since the micro-bubble generator of carbon dioxide is arranged so as to be disposed between the shower unit and the hose, it can be attached to a generally available shower unit and used as it is without any alteration of existing shower equipment.

According to the present invention given in the above description of 4, since the carbonated bath tablet accommodating portion is made with a transparent material, the accommodated carbonated bath tablet can be visually observed externally. Therefore, it is possible to visually recognize a dissolved state of the tablet and a quantity of water which passes through the accommodating portion.

According to the present invention given in the above description of 5, the micro-bubble generator of carbon dioxide can be used by removing the water-flow restricting board which restricts dissolution of the tablet and can be used so that the tablet is completely dissolved in a short period of time.

The micro-bubble generator of carbon dioxide can be used as described above, by which carbonate is sufficiently increased in concentrations, and a user is able to take a shower at high concentrations of carbonate and also able to fully sense smooth skin due to the carbonate. Although the tablet is dissolved in a short period of time, a new tablet is loaded, by which the user is able to take a shower for a prolonged period of time, enjoying the shower without any restrictions.

Further, where there are temporal restrictions on taking a bath, for example, a user has no sufficient time for taking a shower, the user is able to use the micro-bubble generator of carbon dioxide by removing the water-flow restricting board. Thereby, the carbonated bath tablet can be dissolved within a short period of time and used completely by one time shower. It is, therefore, possible to prevent such a drawback that the tablet remaining inside the carbon dioxide gas micro-bubble generator is solidified, resulting in a failure of the carbon dioxide gas micro-bubble generator.

According to the present invention given in the above description of 6, the carbonated bath tablet, the thickness of which is thinner than the diameter thereof is accommodated at the carbonated bath tablet accommodating portion in such a manner that a direction at which the diameter of the carbonated bath tablet extends is the same as a direction at which water will flow. It is, thereby, possible to decrease an area of hot water in contact with the tablet and also slow dissolution time of the tablet without reduction in a quantity of water to be ejected. That is, an area of hot water directly in contact with the tablet can be minimized, by which while a quantity of flowing water is kept, the tablet can be less frequently exposed to hot water to greatly restrict dissolution time, thus making it possible to keep the tablet longer without reduction in a quantity of water to be ejected. In a conventionally known arrangement in which a tablet is accommodated inside a shower head, the tablet is accommodated in such a manner that hot water is directly in contact with a flat face of the tablet. As a result, when water to be ejected is increased in quantity, the tablet will dissolve in a short period of time, by which it is impossible to realize at the same time a favorable quantity of water to be ejected and a prolonged period of dissolution time of the tablet.

In addition, time necessary for obtaining health promoting effects from taking a shower of carbon dioxide gas/micro-bubbles mixed water is in a range of 6 minutes to 8 minutes and time of taking a shower on average is also within the above described range. It is found that even where the tablet is designed to dissolve in a range of 5 minutes to 8 minutes after one time loading of the tablet, a shower unit which uses the present invention capable of decreasing an area of the tablet in contact with water flowing around a circumference face of the tablet is preferable for obtaining a favorable quantity of water.

In this case, even upon ejection of carbonate micro-bubble mixed water, it is possible to obtain health promoting effects such as improvement of blood circulation. The tablet is kept longer and exchanged less frequently, thus making it possible to suppress running costs, while enhancing health promoting effects.

According to the device given in the above description of 7, the water-flow restricting board is formed with a porous board or a network body, by which a quantity of water directly in contact with the tablet can be restricted by using a simple structure to adjust dissolution time optimally. Further, the board is changed to a water-flow restricting board different in a quantity of water which is allowed to pass through (for example, a board different in a quantity of water which is allowed to pass through by changing the dimension and number of openings to change a rate of hole area to a greater or a smaller extent) depending on the necessity. Thereby, the tablet can be adjusted for a rate of dissolution. Since the porous board and the network body are simple in structure, they can be well maintained and reduced in manufacturing costs, in addition to easy adjustment of a quantity of water which is allowed to pass through.

According to the present invention given in the above description of 8, the carbonated bath tablet accommodating portion is provided with the tablet supporting portion formed with a pair of wall like bodies or rod like bodies. The carbonated bath tablet can be fixed reliably in a predetermined direction, thereby providing the effects described in the above description of 5 by using a simple structure without disturbing a water flow.

According to the present invention given in the above description of 9, the water-flow restricting board is installed both on the inlet port side of the carbon dioxide gas micro-bubble generator and on the ejection port side thereof, thereby providing a mode in which the carbonated bath tablet is accommodated by being held between the both water-flow restricting boards. Thereby, the tablet can be retained at the carbonated bath tablet accommodating portion.

Further, the water-flow restricting board on the ejection port side is provided with the tablet supporting portion formed with a pair of wall like bodies which oppose each other along a water flowing direction. It is, thereby, possible to support the carbonated bath tablet in a predetermined direction and also prevent the tablet from flowing to the ejection port side. Further, the carbonated bath tablet is arranged by being held between the pair of wall like bodies, by which side faces of the tablet are in contact with the wall like bodies and not exposed to water flow of hot water. Thus, it is possible to decrease an area of the tablet in contact with the hot water and further retard dissolution of the tablet.

Further, the water-flow restricting board installed on the inlet port side is provided with the water-flow port for allowing hot water flowing inside a pair of wall like bodies to pass through and the external water-flow port (a water-flow port having a large hole area or a great number of water-flow ports are preferable) for allowing the hot water flowing outside the pair of wall like bodies to pass through is installed. Thereby, the hot water which has passed through the water-flow port is in contact with the tablet accommodated inside the pair of wall like bodies, while the hot water which has passed through the external water-flow port flows outside the pair of wall like bodies and is not in contact with the tablet. As a result, it is possible to restrict a quantity of water in contact with the tablet and also keep a quantity of water which is allowed to pass through a whole part of the carbon dioxide gas micro-bubble generator.

MODE FOR CARRYING OUT THE INVENTION

Hereinafter, a description will be given of the micro-bubble generator of carbon dioxide of the present invention by referring to attached drawings.

The present invention relates to a technology of the carbon dioxide gas micro-bubble generator which is capable of easily obtaining carbon dioxide gas/micro-bubbles mixed water having both carbonated spring bath effects and micro-bubble effects, and a technology which is expected to provide cleaning effects and health promoting effects such as improvement of blood circulation by attaching the carbon dioxide gas micro-bubble generator to a shower unit, thereby ejecting in a shower mode hot water in which a carbon dioxide gas ingredient is mixed with micro-bubbles.

In the present invention, "hot water" is called water, hot water which is warmed or heated or a mixture of both. Further, "micro-bubbles" are what is called very small bubbles. In addition, in the present device, unless otherwise specified, "quantity" represents "quantity by mass," "%" represents "% by mass" and "part" represents "part by mass."

Figure 1:
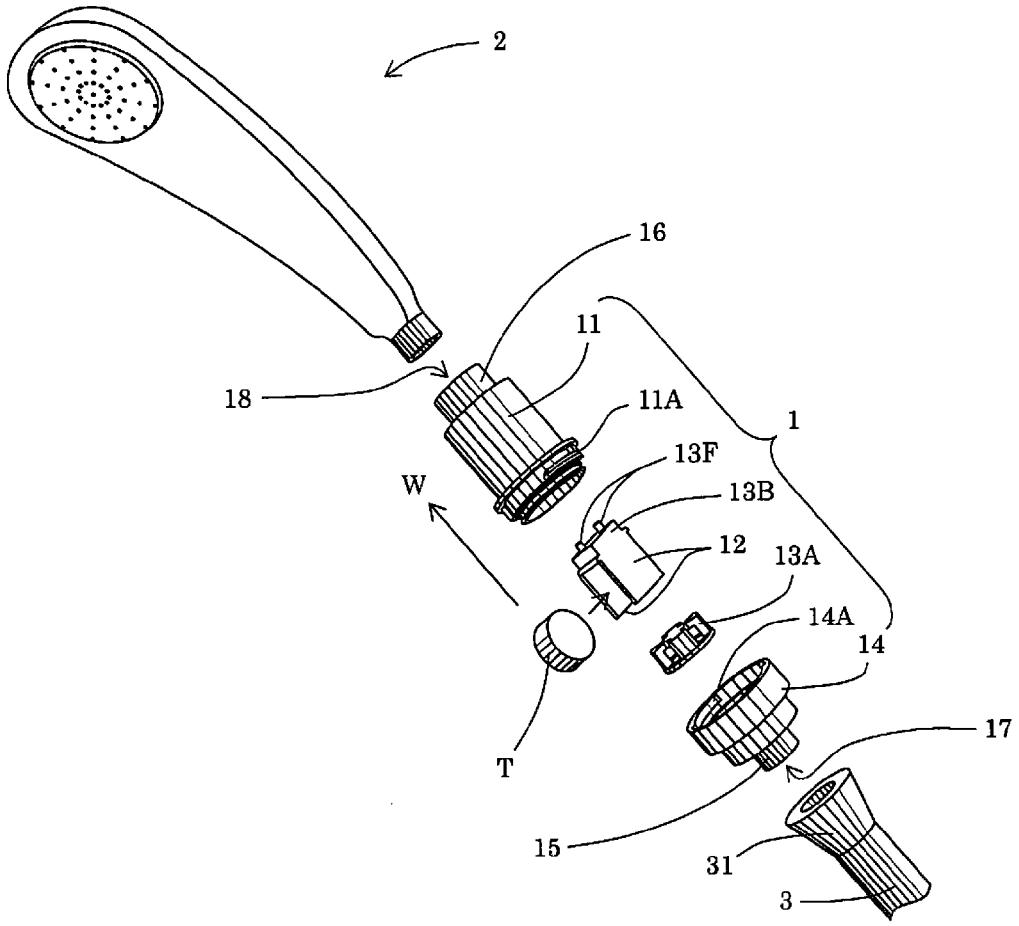
FIG. 1 is an exploded perspective view which shows an example of a micro-bubble generator of carbon dioxide related to the present invention.

FIG. 1 is an exploded perspective view which shows one example of the carbon dioxide gas micro-bubble generator 1 of the present device (hereinafter, simply referred to as "micro-bubble generator.")

The micro-bubble generator 1 accommodates a carbonated bath tablet T and is disposed between a shower unit 2 and a hose 3. The micro-bubble generator 1 to which hot water is supplied through the hose 3 and is able to eject carbon dioxide gas/micro-bubbles mixed water from the shower unit 2.

The micro-bubble generator 1 is disposed between the shower unit 1 and the hose 3 and installed on a water channel extending from the hose 3 up to the shower unit 2, that is, a water supply channel of hot water. Thereby, the carbonated bath tablet T accommodated in the micro-bubble generator 1 is dissolved by hot water flowing through the water channel and carbon dioxide gas generated by dissolving is changed into micro-bubbles (very small bubbles) in the hot water, mixed with the hot water and available as carbon dioxide gas/micro-bubbles mixed water.

In general, a shower unit is used by being connected to a faucet with a hose. However, the hose is connected by being screwed or fitted and can be attached in a detachable manner. Therefore, the micro-bubble generator 1 is attachable to any shower unit with the above-described general arrangement by removing the hose.

In addition, there is a case where the shower unit 2 is directly attached to a wall face of a bath room or the like. In this case, the micro-bubble generator 1 may be attached to a space between the shower unit 2 and the wall face.

The carbonated bath tablet T accommodated in the micro-bubble generator 1 is preferably a tablet which is 15 mm or more in diameter and the thickness of which is thinner than the diameter thereof. The carbonated bath tablet T will be described later.

Next, a description will be given of an arrangement which accommodates the carbonated bath tablet T in the micro-bubble generator 1.

The micro-bubble generator 1 is provided with a carbonated bath tablet accommodating portion 11 (hereinafter, simply referred to as "tablet accommodating portion."). The carbonated bath tablet T is accommodated in the tablet accommodating portion 11 in such a manner that a direction at which the diameter of the carbonated bath tablet T extends is the same as a water flowing direction W or a direction approximately in parallel therewith. A direction at which the carbonated bath tablet T is accommodated is referred to as "a longitudinally accommodating direction." As described previously, it is preferable that the carbonated bath tablet T is formed so that the thickness thereof is thinner than the diameter. The carbonated bath tablet T is accommodated in the longitudinally accommodating direction, thus making it possible to keep small a surface area which is directly exposed to a strong water flow, thereby decreasing a rate of dissolution. As described above, the rate of dissolution is decreased and optimized, by which the carbonated bath tablet T continues to generate micro-bubbles over a longer period of time.

In addition, the tablet accommodating portion 11 is arranged so as to accommodate one carbonated bath tablet T as described in the example or in drawings. However, it is acceptable that the tablet accommodating portion 11 is arranged so as to accommodate two or more carbonated bath tablets T. In this case, it is also acceptable that the two or more carbonated bath tablets T are accommodated in series or in parallel.

Where the tablet accommodating portion 11 is arranged so as to accommodate two or more carbonated bath tablets T, it is acceptable that the plurality of tablets T are directly accommodated in the tablet accommodating portion 11 or a holder which can be accommodated in the tablet accommodating portion 11 is separately provided and the plurality of tablets T are accommodated in the holder and the holder is accommodated in the tablet accommodating portion 11.

Figure 2:
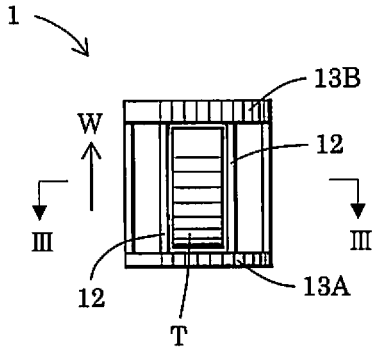
FIG. 2 is a schematic front view which shows a tablet supporting portion of the example in FIG. 1.
Figure 3:
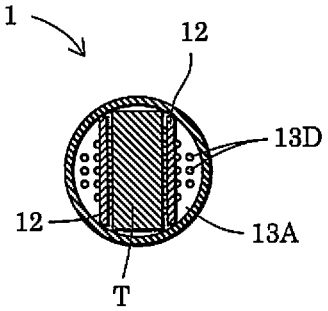
FIG. 3 is a cross sectional view taken along the line III to III in FIG. 2.
Figure 4:
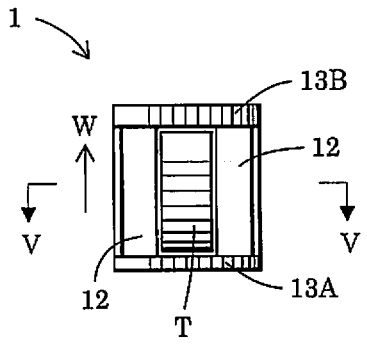
FIG. 4 is a schematic front view which shows a tablet supporting portion of another example.
Figure 5:
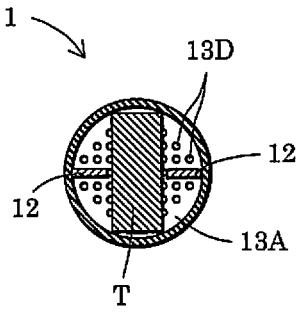
FIG. 5 is a cross sectional view taken along the line V to V in FIG. 4.
Figure 6:
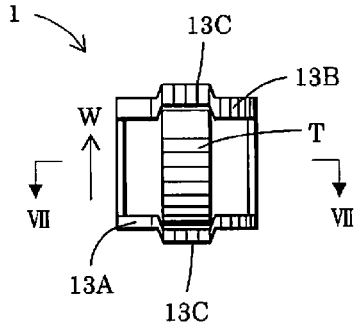
FIG. 6 is a schematic front view which shows a tablet supporting portion of still another example.
Figure 7:
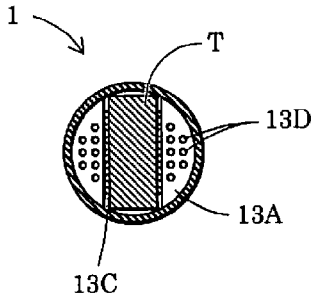
FIG. 7 is a cross sectional view taken along the line VII to VII in FIG. 6.

The tablet accommodating portion 11 is provided with a tablet supporting portion 12 for fixing the carbonated bath tablet T in the longitudinally accommodating direction. FIG. 2 to FIG. 7 are schematic block diagrams which show an example of arranging the tablet supporting portion 12. FIG. 2 is a schematic front view which shows the tablet supporting portion 12 of the example in FIG. 1 in a direction of the front (in a lateral direction). FIG. 3 is a cross sectional view taken along the line III to III in FIG. 2. FIG. 4 is a schematic front view which shows the tablet supporting portion 12 in another example different from the example in FIG. 1 in a direction of the front (in a lateral direction). FIG. 5 is a cross sectional view taken along the line V to V in FIG. 4. FIG. 6 is a schematic front view which shows the tablet supporting portion 12 in still another example different from the example in FIG. 1 in a direction of the front (in a lateral direction). FIG. 7 is a cross sectional view taken along the line VII to VII in FIG. 6.

For example, as shown in FIG. 2 and FIG. 3, the tablet supporting portion 12 can be installed by using a pair of wall like bodies formed along the water flowing direction W. In a similar manner, the carbonated bath tablet T is placed between the pair of wall like bodies, by which the carbonated bath tablet T can be supported and fixed in the longitudinally accommodating direction.

Further, for example, as shown in FIG. 4 and FIG. 5, the tablet supporting portion 12 can be installed by using a pair of rod like bodies formed along the water flowing direction W. The carbonated bath tablet T is held between the pair of rod like bodies, thus making it possible to support and fix the carbonated bath tablet T in the longitudinally accommodating direction.

Still further, for example, as shown in FIG. 6 and FIG. 7, the tablet supporting portion 12 can be installed in such a manner that a recessed portion 13C into which the carbonated bath tablet is partially inserted is formed at a part of a water-flow restricting board 13 to be described later. In this case, the water-flow restricting board 13 is installed both on the side of an inlet port 17 and on the side of an ejection port 18 so as to hold the carbonated bath tablet T between them. The carbonated bath tablet T is fitted into the recessed portion 13C installed on both or one of the water-flow restricting boards 13 and also the carbonated bath tablet T is held between the water-flow restricting boards 13, thus making it possible to support and fix the carbonated bath tablet T in the longitudinally accommodating direction. It is acceptable that the recessed portion 13C is installed on one of an inlet port side water-flow restricting board 13A and an ejection port side water-flow restricting board 13B or on both of them.

It is acceptable that the tablet supporting portion 12 is constituted with the recessed portion 13C installed on the water-flow restricting board 13, together with the rod like bodies or the wall like bodies as shown in FIG. 2 to FIG. 5, or the tablet supporting portion 12 is constituted with the recessed portion 13C alone.

The micro-bubble generator 1 is provided with the water-flow restricting board 13 for decreasing a quantity of water in contact with the carbonated bath tablet T both or either upstream or downstream at a position which accommodates the carbonated bath tablet T, that is, both or either on the side of the inlet port 17 of hot water or on the side of the ejection port 18 thereof. Here, the water-flow restricting board installed on the inlet port side 17 of hot water is referred to as an inlet port side water-flow restricting board 13A, while the water-flow restricting board installed on the side of the ejection port 18 of hot water is referred to as an ejection port side water-flow restricting board 13B. Further, in the present device, a simple description of the water-flow restricting board 13 represents both or one of the inlet port side water-flow restricting board 13A and the ejection port side water-flow restricting board 13B, unless otherwise specified.

The water-flow restricting board 13 is arranged so as to give a partition which allows hot water to pass through and can be formed with, for example, a porous board having a plurality of water-flow ports or a network body like a mesh body.

Where the water-flow restricting board 13 is installed on one of the side of the inlet port 17 of hot water or the side of the ejection port 18 thereof, it is preferable that the inlet port side water-flow restricting board 13A is installed only on the side of the inlet port 17. In this case, since hot water flowing through the water channel will flow from the side of the inlet port 17, water pressure is strong on the side of the inlet port 17. The water pressure is restricted by using the inlet port side water-flow restricting board 13A, thus making it possible to obtain such effects that will retard a rate of dissolution of the carbonated bath tablet T and keep the tablet T longer.

The water-flow restricting board 13 also functions to restrict movement of the carbonated bath tablet T. According to such an arrangement that the water-flow restricting board 13 is installed both on the side of the inlet port 17 of hot water and on the side of the ejection port 18 thereof, a mode is provided in which the carbonated bath tablet T is accommodated by being held between the inlet port side water-flow restricting board 13A and the ejection port side water-flow restricting board 13B. It is thus, possible to prevent the tablet T from flowing out by a water flow and retain the tablet T at the carbonated bath tablet accommodating portion 11.

As shown in FIG. 1, where the water-flow restricting board 13 is installed both on the side of the inlet port 17 of hot water and on the side of the ejection port 18 thereof, there is adopted an arrangement by which the carbonated bath tablet T is enclosed. Further, as described previously, the recessed portion 13C is installed on the water-flow restricting board 13, thus making it possible to support and fix the carbonated bath tablet T in the longitudinally accommodating direction.

Since the plurality of water-flow restricting boards 13 different in a quantity of water which is allowed to pass through are provided to adjust a rate of dissolution of the carbonated bath tablet T, they can be selected and exchanged accordingly. That is, where it is desired to increase the rate of dissolution of the carbonated bath tablet T, there is used a water-flow restricting board 13 which is great in a quantity of water which is allowed to pass through. On the other hand, where it is desired to decrease the rate of dissolution of the carbonated bath tablet T, there can be used a water-flow restricting board 13 which has a water-flow port lower in a quantity of water which is allowed to pass through.

Where the water-flow restricting board 13 is formed with a porous board having a plurality of water-flow ports 13D, the water-flow port 13D can be changed in dimension and number, thus making it possible to change a quantity of water which is allowed to pass through. Further, where the water-flow restricting board 13 is formed with a network body like a mesh body, the network body is changed in mesh size, thus making it possible to change a quantity of water which is allowed to pass through.

Further, as means for changing the rate of dissolution of the carbonated bath tablet T, there are adopted means for exchanging to a water-flow restricting board 13 different in a quantity of water which is allowed to pass through as described above and means which uses a water-flow restricting board 13 capable of changing a quantity of water which is allowed to pass through. There is also adopted means in which, for example, two porous boards different in the dimension and the number of water-flow ports 13D are stacked together to give one water-flow restricting board 13, and both or one of the two porous boards are rotated to adjust the dimension and the number of the water-flow ports 13D through which hot water is allowed to pass, thereby changing a rate of hole area and consequently changing a quantity of water which is allowed to pass through the water-flow restricting board 13.

The water-flow restricting board 13 can be used by being removed from the carbon dioxide gas micro-bubble generator 1. For example, where a user is required to take a quick shower, it is acceptable that the water-flow restricting board 13 is removed to eject water in a shower mode, thereby increasing a rate of dissolution of the carbonated bath tablet T and dissolving the tablet in a short period of time. In this case, carbon dioxide gas/micro-bubbles mixed water to be ejected in a shower mode is high in carbonate concentration, thus making it possible to obtain effects such as sufficient improvement of blood circulation in a short period of time.

For the micro-bubble generator 1, in particular, the tablet accommodating portion 11 is made with a transparent material such as a transparent synthetic resin material, by which the carbonated bath tablet T accommodated in the tablet supporting portion 11 is arranged so as to be visually observed externally the micro-bubble generator 1. According to the above described arrangement, it is possible to understand easily the presence or absence of the carbonated bath tablet T accommodated in the micro-bubble generator 1 and an extent of dissolution from outside.

The example in FIG. 1 is arranged in such a manner that a connection portion 14 is installed at an end on the side of the inlet port 17 of the tablet accommodating portion 11. This arrangement is such that the connection portion 14 is removed, by which the inlet port side water-flow restricting board 13A can be removed to load or unload the carbonated bath tablet T. In the example in FIG. 1, since the connection portion 14 is installed, the micro-bubble generator 1 is provided with an opening/closing mechanism.

A hose connection portion 15 is installed at the other end of the connection portion 14, by which the micro-bubble generator 1 can be connected with the hose 3. It is acceptable that a connector 31 is installed at an end of the hose 3 so as to be easily connected with the hose connection portion 15. Further, where the hose connection portion 15 is not in agreement in dimension (diameter) with the end of the hose 3 or the connector 31 attached thereto, an adjustor (not illustrated) may be placed between them.

There are no restrictions on a mode of the connection portion 14. It is, however, preferable that the tablet accommodating portion 11 is connected with the connection portion 14 by being screwed or fitted so that they will not be detached upon application of a strong water pressure. It is also possible to provide a locking mechanism or the like.

There are no restrictions on a mode of the hose connection portion 15 either. A connection portion of the hose 3 which is connected to the shower unit 2 is in many cases formed with a screw or the like on the basis of a certain specification. Thus, the hose connection portion 15 is preferably available as a screw or the like complying with the specification.

The shower unit 2 which is connected with the micro-bubble generator 1 may include any publicly-known shower unit without any particular restrictions. The shower unit 2 may include, for example, an integral shower unit in which a shower head portion is integrally formed with a shower body portion, a shower unit in which separate portions are connected or jointed so as to give an integral unit, and a shower unit in which a shower head portion is directly or indirectly connected so as to change in direction or angle with respect to a shower body portion. It is also acceptable that the shower unit 2 is arranged so as not to have a shower body portion and the shower unit 2 is such a mode that it is constituted with a shower head portion alone.

It is acceptable that the shower unit 2 includes a shower unit used, for example, at a beauty parlor in which ejection means can be changed to shower-mode ejection or straight-mode ejection and a shower unit in which ejection is done by means other than the shower-mode ejection.

Further, the hose 3 connected with the micro-bubble generator 1 may include any publicly-known hose as a hose connected with a shower unit without any particular restrictions.

The micro-bubble generator 1 can be provided with a shower connection portion 16 for being connected with the shower unit 2.

In the example in FIG. 1, the shower connection portion 16 is installed at an end on the side of the ejection port 18 of the micro-bubble generator 1. There are no restrictions on the shape of the shower connection portion 16. In general, a shower unit is tapped so as to be connected with the hose. Therefore, it is preferable that the shower connection portion 16 is formed in such a shape that complies with the shower unit. Further, where the shower connection portion 16 is not applicable in size (dimension) with the shower unit 2 to be connected, it is acceptable that an adjustor (not illustrated) is placed between them for adjusting a dimensional difference.

There are no restrictions on a mode of the shower connection portion 16 either. The connection portion with the hose 3 of the shower unit 2 is often formed with a screw or the like on the basis of a certain specification. Therefore, it is preferable that the shower connection portion 16 is provided in a mode of a screw or the like complying therewith.

A sealing member such as a packing is installed at a connection site of each member which constitutes the micro-bubble generator 1, whenever necessary, thereby making it possible to prevent hot water from leaking outside from a water channel. It is preferable that the sealing member is installed at a connection site which can be attached in a detachable manner, in particular, at a connection site between the shower unit 2 and the tablet accommodating portion 11 (or the shower connection portion 16), a connection site between the tablet accommodating portion 11 and the connection portion 14 or a connection site between the hose connection portion 15 and the hose 3 (or the connector 31).

The carbonated bath tablet used in the present invention may include any publicly known carbonated bath tablet without any particular restrictions. The previously described carbonated bath tablets (1) to (5) may be in particular preferably adopted.

The carbonated bath tablet is not necessarily formed in the shape of a circle having a flat face. As long as the tablet is a solid substance in which one side is 15 mm or more in length and, the hardness of which is preferably 15 kgf or more or 15 HV or more, it includes any tablet formed in an oval shape or a spherical shape, without any restrictions on the shape.

Coloring ingredients which may be contained in the carbonated bath tablet include any publicly known natural and synthetic coloring agents and coloring matters used in a bathing agent without any particular restrictions.

Further, aromatic ingredients which may be contained in the carbonated bath tablet include any publicly known natural and synthetic aromatic agents and flavors used in a bathing agent, a facial cleaner and soap etc., without any particular restrictions.

In particular, in a mode in which the carbonated bath tablet is arranged so as to contain a coloring ingredient, there are used in combination an arrangement that the previously described tablet accommodating portion is formed with a transparent material and an arrangement that a shower head portion and/or a shower body portion are at least partially made with a transparent material and a water channel thereinside is at least partially made with a transparent material. Thereby, it is possible to easily understand the presence or absence of the carbonated bath tablet and an extent of dissolution of the tablet.

EXAMPLE

FIG. 1 is an exploded perspective view which shows a specific example of the micro-bubble generator 1 of the present invention.

The micro-bubble generator 1 of the example is an example which is constituted with a carbonated bath tablet accommodating portion 11, a tablet supporting portion 12, water-flow restricting boards 13A, 13B and a connection portion 14 and disposed between a shower unit 2 and a hose 3.

The tablet accommodating portion 11 is such that an end on the side of the ejection port 18 is connected with an end of the shower unit 2. Although there are no restrictions on connection means, it is possible to adopt any publicly-known connection means such as screwing and fitting means. The shower connection portion 16 is formed in such a shape complying with the connection means.

The tablet accommodating portion 11 is formed with a transparent material and arranged in such a manner that the carbonated bath tablet T or the like to be accommodated may be visually observed externally.

A first engaging portion 11A is installed at a part of a side circumferential face of the tablet accommodating portion 11 and fitted into a first engaged portion installed on the connection portion 14 to be described later. The first engaging portion 11A is engaged therewith by twisting the first engaged portion, with rotation at 360 degrees or less given thereto.

The water-flow restricting board 13 is such that an inlet port side water-flow restricting board 13A is placed on the side of the inlet port 17 of the tablet accommodating portion 11 and an ejection port side water-flow restricting board 13B is placed on the side of the ejection port 18.

The inlet port side water-flow restricting board 13A is installed so as be internally contained in the connection portion 14 and disposed at an end on the side of the inlet port 17 of the tablet accommodating portion 11 in a state that each part constituting the micro-bubble generator 1 has been assembled, as shown in FIG. 1.

Figure 8:
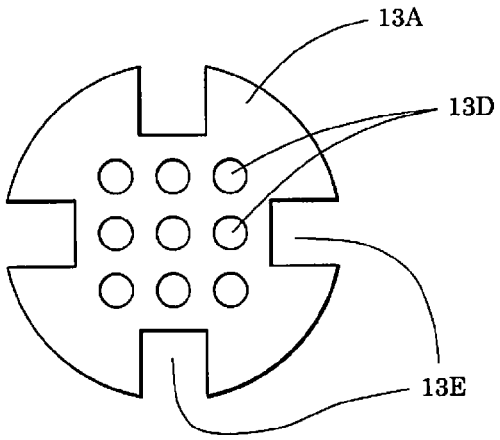
FIG. 8 is a schematic plan view which shows an inlet port side water-flow restricting board of the example in FIG. 1.

FIG. 8 is a schematic plan view which shows the inlet port side water-flow restricting board 13A from the side of the shower unit 2. The inlet port side water-flow restricting board 13A is formed in a circular shape when viewed from above. A plurality of water-flow ports 13D are provided at the center of the restricting board 13A and external water-flow ports 13E are provided at an external circumferential border by being notched. The water-flow ports 13D and the external water-flow ports 13E will be described later in detail.

The ejection port side water-flow restricting board 13B is disposed at an end on the side of the ejection port 18 of the tablet accommodating portion 11.

Figure 9:
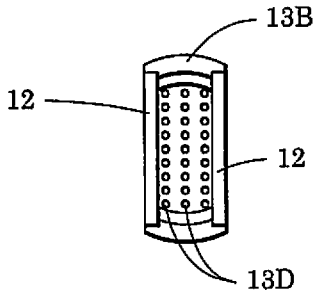
FIG. 9 is a schematic bottom view which shows an ejection port side water-flow restricting board and a tablet supporting portion of the example in FIG. 1.
Figure 10:
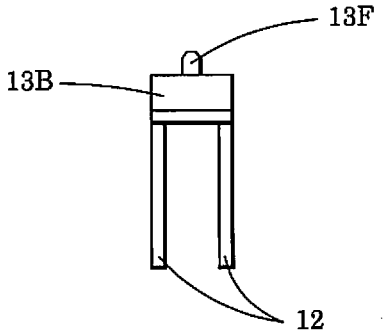
FIG. 10 is a schematic front view which shows the ejection port side water-flow restricting board and the tablet supporting portion of the example in FIG. 1.

FIG. 9 is a schematic bottom view which shows the ejection port side water-flow restricting board 13B observed from the side of the inlet port 17. Further, FIG. 10 is a schematic front view which shows the ejection port side water-flow restricting board 13B observed from a lateral direction of a shower body portion 12.

The ejection port side water-flow restricting board 13B is formed in a rectangular shape in which upper and lower sides are curved when viewed from above and provided with a plurality of water-flow ports 13D. As shown in FIG. 9 and FIG. 10, the ejection port side water-flow restricting board 13B is also provided with a tablet supporting portion 12 and an engaging portion 23F.

The tablet supporting portion 12 is composed of two wall-like bodies which are paired. The pair of wall-like bodies are formed so as to oppose each other along a water flowing direction W. Where the carbonated bath tablet T is accommodated in the tablet accommodating portion 11, the carbonated bath tablet T is held between the pair of wall-like bodies.

A second engaging portion 13F is engaged with a second engaged portion (not illustrated) installed at the tablet accommodating portion 11. The second engaging portion 13F is a site which fixes the ejection port side water-flow restricting board 13B so as to be positioned at an end on the side of the ejection port 18 of the tablet accommodating portion 11.

The second engaging portion 13F is a small projection formed in a cylindrical shape and engaged with a second engaged portion (not illustrated) in a recessed or an open-hole shape formed so as to comply with the diameter of the small projection. In addition, in the present device, the second engaging portion 13F and the second engaged portion are not restricted to the above described arrangement but any publicly-known technology on engagement means may be adopted without any particular restrictions.

Here, a description will be again given of the water-flow port 13D and the external water-flow port 13E which are installed on the inlet port side water-flow restricting board 13A.

The water-flow port 13D is an open hole which allows hot water flowing inside the pair of wall-like bodies constituting the above described tablet supporting portion 12 to pass through. More specifically, where seen from the side of the ejection port 18 in a direction parallel with the water flowing direction W, the water-flow port 13D is installed inside the pair of wall-like bodies constituting the tablet supporting portion 12.

The external water-flow port 13E is an open hole which allows the hot water flowing outside the pair of wall-like bodies constituting the previously described tablet supporting portion 12 to pass through. More specifically, where observed from the side of the ejection port 18 in a direction parallel with the water flowing direction, the external water-flow port 13E is installed outside the pair of wall-like bodies constituting the tablet supporting portion 12.

In the above described arrangement, a relatively small quantity of hot water which has passed through the water-flow port 13D is in contact with the tablet T accommodated inside the pair of wall-like bodies, while a relatively large quantity of hot water which has passed through the external water-flow port 13E passes through the outside of the pair of wall-like bodies and is not in contact with the tablet T. It is, therefore, possible to restrict a quantity of water in contact with the tablet T and keep a quantity of water which may pass through a whole part of the micro-bubble generator 1.

The connection portion 14 is formed in a flange shape and installed for connecting the tablet accommodating portion 11 with the hose 3. It is connected with the hose 3 by being screwed via the hose connection portion 15 and the connector 31.

A first engaged portion 24A is formed by a L-letter shaped groove on an inner circumference of the connection portion 14 and engaged with the first engaging portion 11A installed at the tablet accommodating portion 11, by which the connection portion 14 is connected with the tablet accommodating portion 11.

Figure 11:
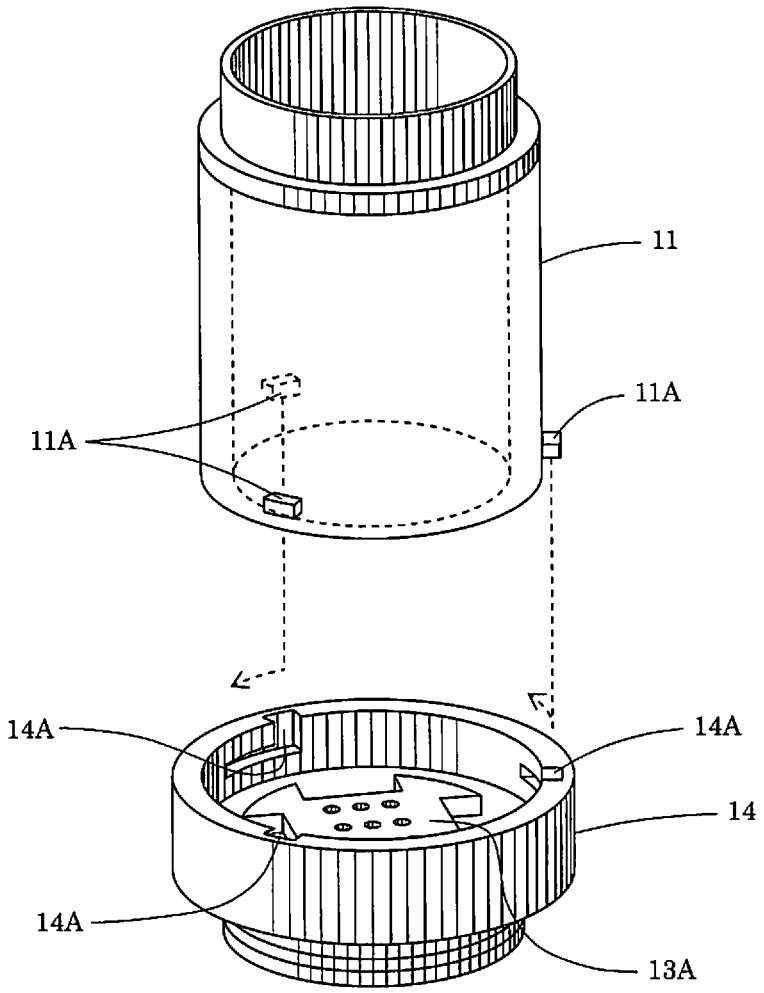
FIG. 11 is a schematic perspective view which explains engagement means between a tablet accommodating portion and a connection portion in another example.

A description will be given of how the first engaging portion 11A is connected with the first engaged portion 24A with reference to FIG. 11. The first engaging portion 11A is connected with the first engaged portion 24A in such a manner that the first engaging portion 11A advances into the first engaged portion 24A in a longitudinal direction of the shower body portion 12 and is twisted in a circumferential direction slightly (at 360 degrees or less) after being butted against. As described above, twisting motion is slightly given, by which they can be easily connected. And, they can also be easily disconnected by being reversely twisted.

In addition, a plurality of projected pieces are provided as slip stoppers on an outer circumference of the connection portion 14.

DESCRIPTION OF REFERENCE NUMERALS

1: carbon dioxide gas micro-bubble generator
11: carbonated bath tablet accommodating portion
11A: first engaging portion
12: tablet supporting portion
13: water-flow restricting board
13A: inlet port side water-flow restricting board
13B: ejection port side water-flow restricting board
13C: recessed portion
13D: water-flow port
13E: external water-flow port
13F: second engaging portion
14: connection portion
14A: first engaged portion
15: hose connection portion
16: shower connection portion
17: inlet port
18: ejection port
2: shower unit
3: hose
31: connector
T: carbonated bath tablet
W: water flowing direction

What is claimed is:

1. A micro-bubble generator of carbon dioxide, which is installed at a water supply channel of hot water to eject carbon dioxide gas/micro-bubbles mixed water, comprising an opening/closing mechanism and a carbonated bath tablet accommodating portion for accommodating a carbonated bath tablet, wherein the micro-bubble generator of carbon dioxide is disposed between a shower unit and a hose.

2. The micro-bubble generator of carbon dioxide according to claim 1, in which the opening/closing mechanism is arranged so as to be opened and closed by rotational movement at 360 degrees or less on the basis of a fixation reference body composed of the shower unit, thereby the carbonated bath tablet can be exchanged.

3. The micro-bubble generator of carbon dioxide according to claim 1, in which a water-flow restricting board for adjusting a quantity of water directly in contact with the carbonated bath tablet is installed at least on one of an inlet port side of hot water and an ejection port side thereof.

4. The micro-bubble generator of carbon dioxide according to claim 1, in which at least a part of the carbonated bath tablet accommodating portion is made with a transparent material and the thus accommodated carbonated bath tablet can be visually observed externally.

5. The micro-bubble generator of carbon dioxide according to claim 3, in which at least a part of the water-flow restricting board is arranged so as to be attached in a removable manner.

6. The micro-bubble generator of carbon dioxide according to claim 1, in which the thickness of the carbonated bath tablet is thinner than the diameter thereof, and the carbonated bath tablet is accommodated in the carbonated bath tablet accommodating portion in such a manner that a direction of the diameter of the carbonated bath tablet is the same as a direction at which water will flow inside the carbon dioxide gas micro-bubble generator.

7. The micro-bubble generator of carbon dioxide according to claim 3, in which the water-flow restricting board is formed with a porous board or a network body.

8. The micro-bubble generator of carbon dioxide according to claim 1, in which the carbonated bath tablet accommodating portion is arranged so as to have a tablet supporting portion composed of a pair of wall like bodies or rod like bodies.

9. The micro-bubble generator of carbon dioxide according to claim 3, in which the water-flow restricting board is installed both on the inlet port side of hot water and on the ejection port side thereof, a tablet supporting portion composed of a pair of wall like bodies formed so as to oppose each other in a water flowing direction is installed at the water-flow restricting board installed on the ejection port side, and the carbonated bath tablet is disposed inside the pair of wall like bodies, and the water-flow restricting board installed on the inlet port side is formed with a porous board, which is provided with a water-flow port that allows hot water flowing inside the pair of wall like bodies to pass through and also with an external water-flow port that allows hot water flowing outside the pair of wall like bodies to pass through.

* * * * *